US007683282B2

(12) United States Patent
Kloth et al.

(10) Patent No.: US 7,683,282 B2
(45) Date of Patent: Mar. 23, 2010

(54) MECHANICAL SWITCHING CONTACT

(75) Inventors: Günter Kloth, Saal (DE); Silke Wrede, Zeitlarn (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 322 days.

(21) Appl. No.: 11/792,457

(22) PCT Filed: Jul. 22, 2006

(86) PCT No.: PCT/EP2006/007230

§ 371 (c)(1),
(2), (4) Date: Jun. 6, 2007

(87) PCT Pub. No.: WO2007/042088

PCT Pub. Date: Apr. 19, 2007

(65) Prior Publication Data

US 2008/0128257 A1 Jun. 5, 2008

(30) Foreign Application Priority Data

Oct. 8, 2005 (DE) ..... 10 2005 048 308

(51) Int. Cl.
*H01H 5/10* (2006.01)

(52) U.S. Cl. ..... 200/560; 200/11 TC; 200/459

(58) Field of Classification Search ..... 200/560–565, 200/409, 416, 447–454, 11 TC, 1 R, 6 R, 200/11 R
See application file for complete search history.

(56) References Cited

U.S. PATENT DOCUMENTS

| | | | | |
|---|---|---|---|---|
| 3,798,395 | A * | 3/1974 | Norman et al. | 200/17 R |
| 4,939,319 | A | 7/1990 | Bleibtreu | 200/11 |
| 5,523,535 | A * | 6/1996 | Larsson et al. | 200/11 TC |
| 6,740,831 | B2 * | 5/2004 | Baertl et al. | 200/459 |
| 2003/0102205 | A1 | 6/2003 | Baertl | 200/462 |

FOREIGN PATENT DOCUMENTS

| | | |
|---|---|---|
| DE | 4101866 | 7/1992 |

* cited by examiner

*Primary Examiner*—Renee S Luebke
*Assistant Examiner*—Marina Fishman
(74) *Attorney, Agent, or Firm*—Andrew Wilford

(57) ABSTRACT

The invention relates to a mechanical switching contact having an insulating material support (1), on which fixed contacts (4, 5, 6) are arranged. Furthermore, a switching lever (2) is mounted such that it can rotate on the insulating material support (1) and has a pivoting arm (22). In addition, a pivotable contact housing (3) is also mounted on the insulating material support (1), which contact housing bears parallel contact fingers (9, 10), which surround the respectively connected fixed contacts (4, 5, 6) on both sides when contact is made.

3 Claims, 7 Drawing Sheets

MECHANICAL SWITCHING CONTACT

CROSS REFERENCE TO RELATED APPLICATIONS

This application is the US national phase of PCT application PCT/EP2006/007230, filed 22 Jul. 2006, published 19 Apr. 2007 as WO2007/042088, and claiming the priority of German patent application 102005048308.9 itself filed 8 Oct. 2005, whose entire disclosures are herewith incorporated by reference.

FIELD OF THE INVENTION

The invention relates to a mechanical switch contact for switching in a load transfer switch in a tap changer.

BACKGROUND OF THE INVENTION

A mechanical switch contact for bipolar interruption for a tap changer is known from DE-PS 100 50 821 [U.S. Pat. No. 6,740,831]. The known mechanical switch contact has an insulating support on which fixed contacts are arranged that have crowned-shaped contact areas. Furthermore, rotatably mounted on this insulating support is a contact carrier that is in contact with a pivot arm that can pivot through a certain angle. Attached at the free end of the pivot arm is a contact piece that itself has contact rollers at each of its ends. The fixed contacts can be switched as desired using these contact rollers. Depending on the position of the pivot arm, the contact rollers encounter the crowned surface of corresponding fixed contacts arranged opposite thereto and electrically connect these to one another.

This mechanical switch contact has proven itself in practical use; however, it has disadvantages during bipolar interruption of very high current. For one thing, with the above-described structural configuration of the crowned-shaped fixed contacts and the pivotal contact rollers, undesired contact impacts can occur, and in addition in this bipolar interrupting design there are high current forces that reduce the pressure of the contact rollers against the fixed contacts. The reason for this is the physical effect that reducing forces occur due to the current reduction on the narrow locations of a surface contact.

OBJECT OF THE INVENTION

Therefore the object of the invention is to provide a mechanical switch contact that also permits reliable, certain, impact-free and arc-free switching or contacting, even with high current.

SUMMARY OF THE INVENTION

This object is attained using a mechanical switch contact also mounted on the insulating support (1) a contact housing that can be pivoted about a separate bearing). The contact housing carries two parallel contact fingers that are electrically connected to one another and that flank the switched fixed contacts on both sides. This contact housing is mechanically connected to the switching lever and actuatable thereby.

Using the inventive configuration of the movable contacts as contact fingers that enclose the fixed contacts on both sides, initially contact impact is reduced. Furthermore a high, constant contact pressure results with the inventive solution.

BRIEF DESCRIPTION OF THE DRAWING

The invention will be described in greater detail using examples in the drawings.

SPECIFIC DESCRIPTION

Figure 1:
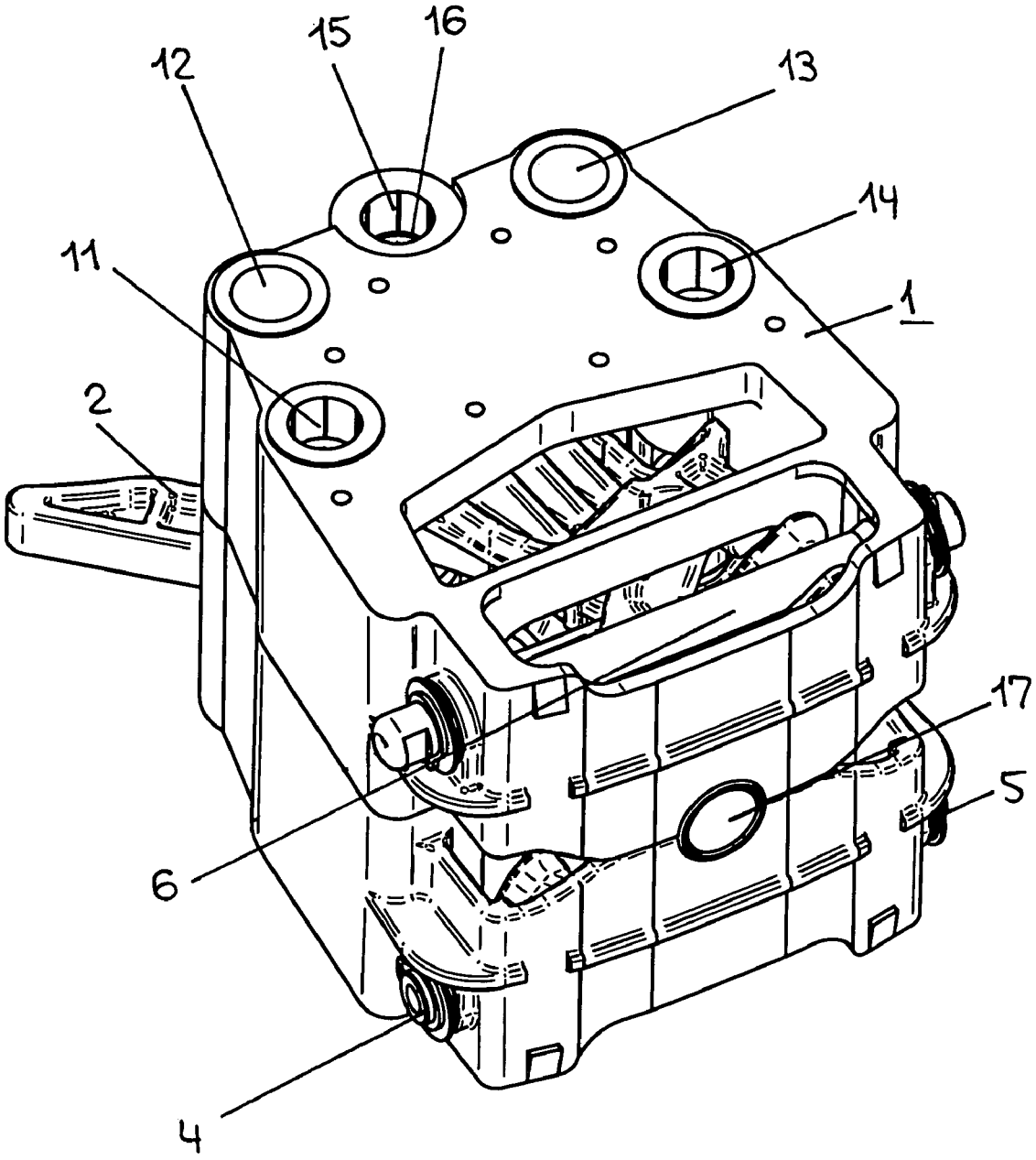
FIG. 1 is a perspective view of the inventive mechanical switch contact in its entirety.
Figure 2:
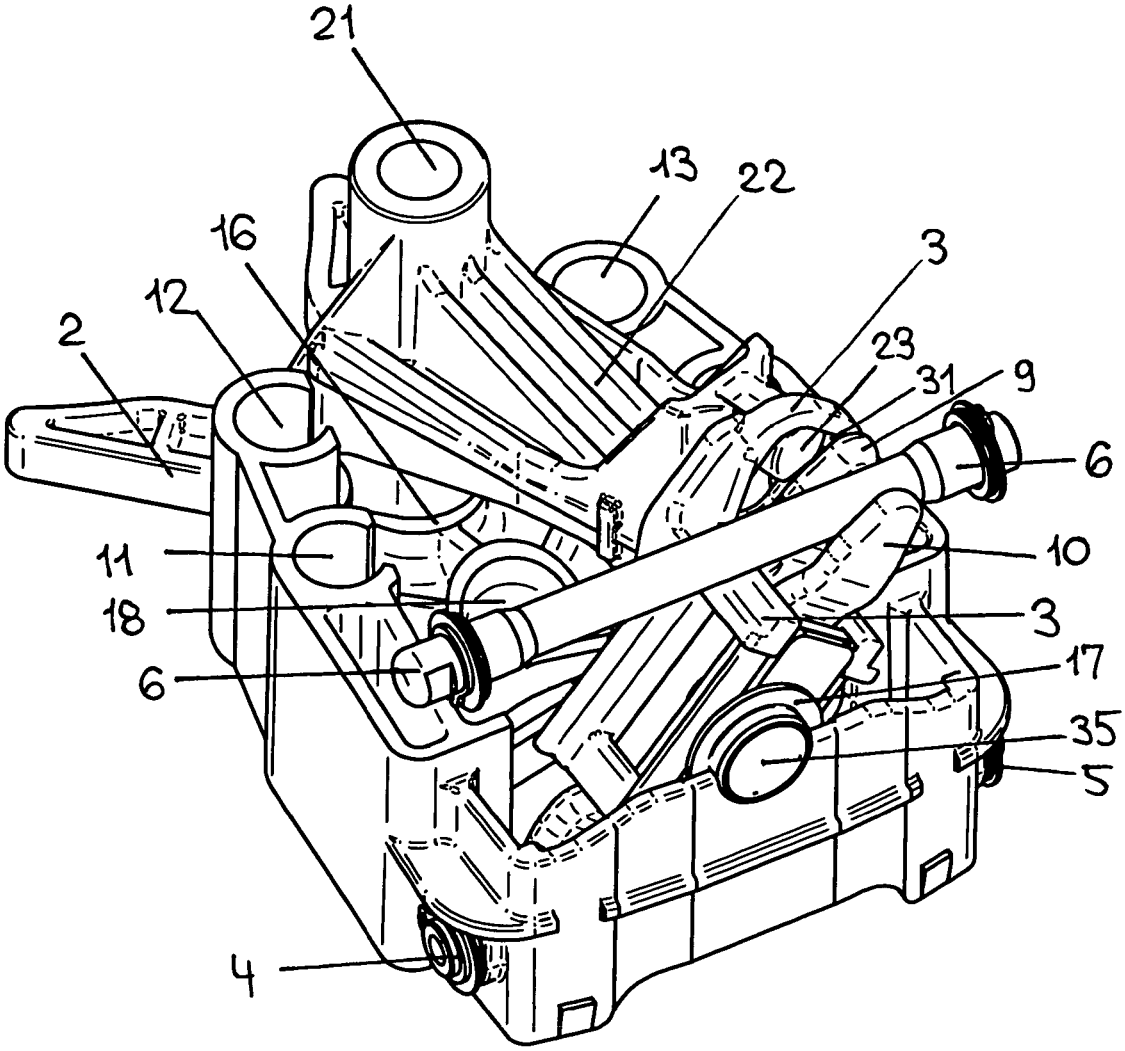
FIG. 2 shows this mechanical switch contact with the top part of the insulating support (to be explained later) removed.

Initially the mechanical switch contact in accordance with the invention and shown in FIGS. 1 and 2 will be explained in greater detail. It has a two-part insulating support 1 that receives the other components described below and encloses the entire arrangement. In FIG. 2 the upper part of the two-part insulating support 1 is omitted in order to facilitate better illustration of the components mounted in its interior. The insulating support 1 is provided with longitudinal bores 11-14, each running in a molded shaft formation that will be discussed in greater detail below. Near another longitudinal bore 15 is a bearing 16 in which a switching lever 2 is rotatably mounted by means of a bearing bolt (not shown). On the side is another bearing 17 that receives a contact housing 3 that will be described in greater detail below. Finally, provided on the insulating support 1 are cup-shaped seats 18 in which compression springs 8 are supported that will also be described below. Two spaced-apart fixed contacts 4 and 5 and a contact rod 6 are mounted on the insulating support 1.

Figure 3:
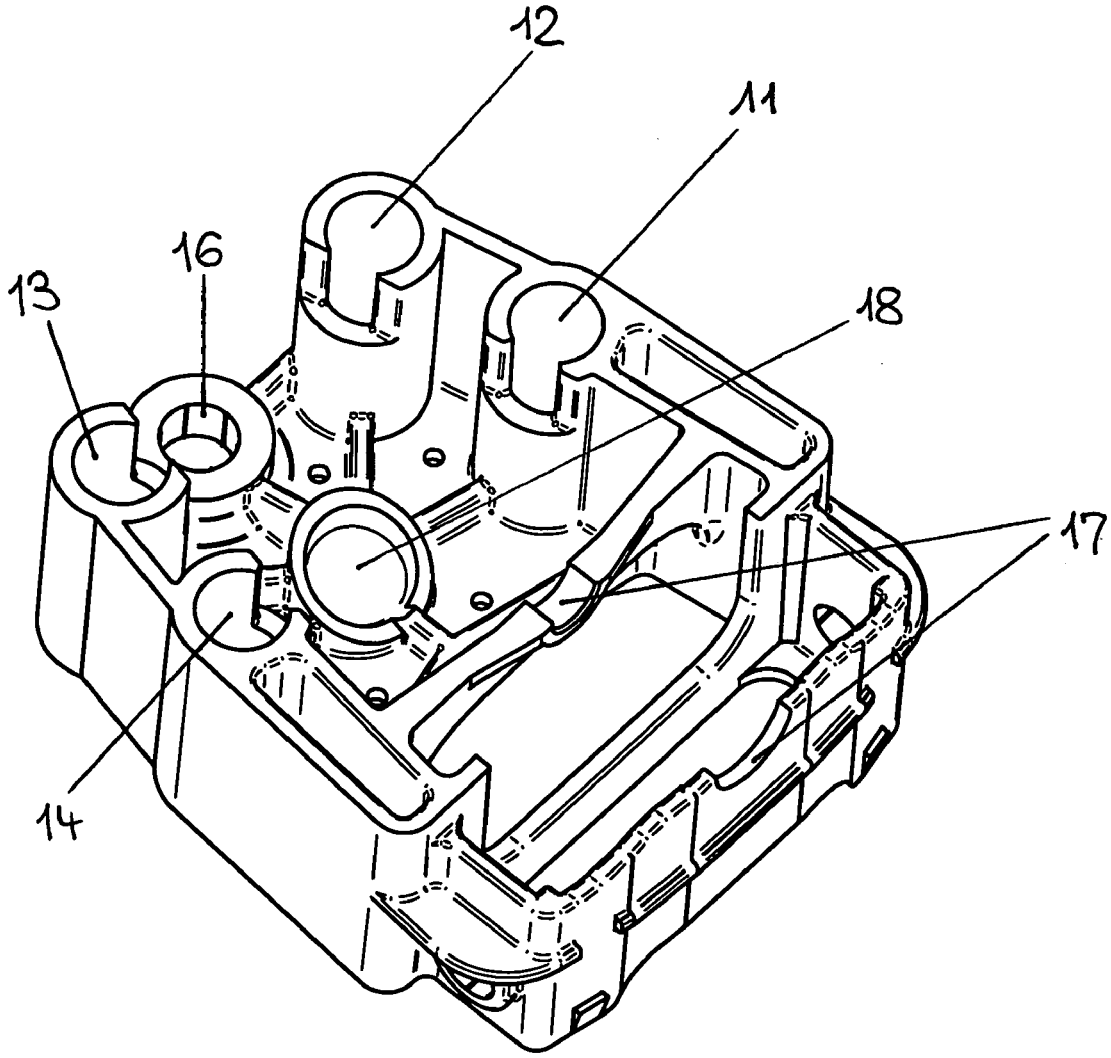
FIG. 3 shows this insulating support alone, without additional assembled components.

The described insulating support is shown again separately in FIG. 3.

Figure 4:
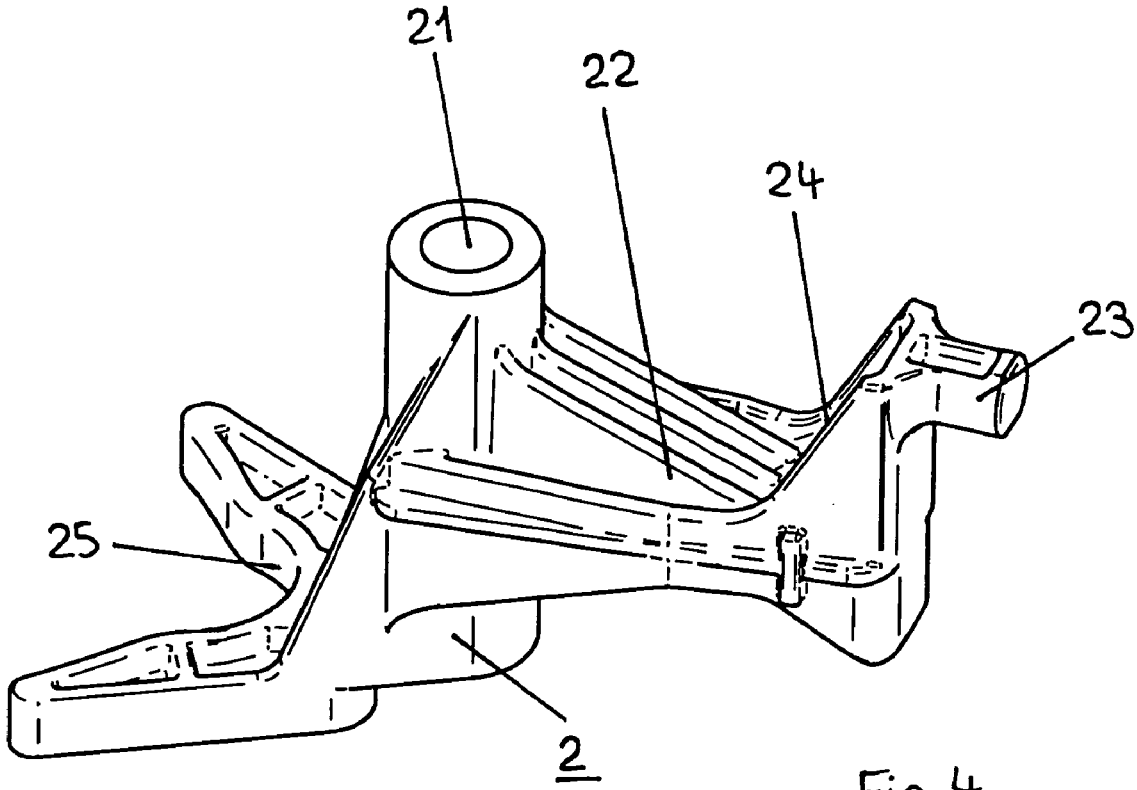
FIG. 4 is a switching lever for the switch contact, alone.

The switching lever 2, which is shown alone in FIG. 4, is rotatably attached to the bearing 16 of the insulating support 1 by means of a bearing 21. It has a pivot arm 22 that can be pivoted about the bearing 21 and that itself at its free end possesses an entrainment element 23. Provided laterally in the pivot arm 22 are two support seats 24 that are cup-shaped and that likewise hold the compression springs 8, which will be described later. At its other opposite free end the switching lever 2 has a fork-shaped actuating cam 25.

Figure 5:
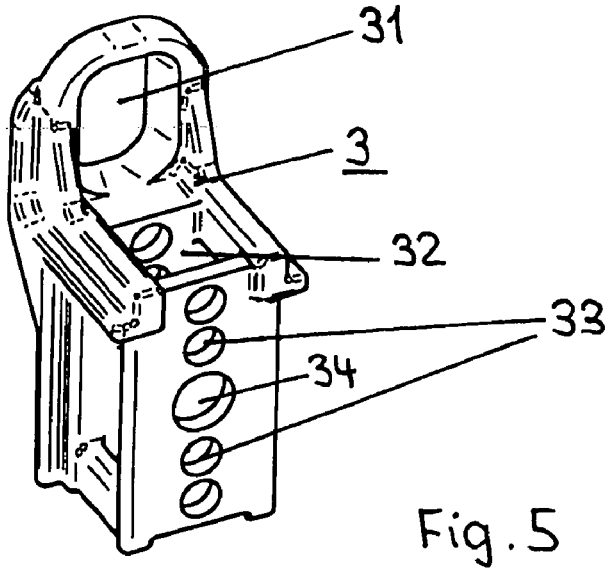
FIG. 5 is a contact housing for the switch contact, alone.

The contact housing 3, which is shown alone in FIG. 5, has an entrainment-element opening 31 in which the entrainment element 23 of the switching lever 2 engages. The contact housing 3 furthermore has a contact seat 32 with spring guide 33 to which are attached parallel contact fingers 9 and 10 that are held by a bearing bolt 35. The contact housing 3 is pivotally mounted on a bearing 34 and the bearing bolt 35 on the bearing 17 of the insulating support 1.

Figure 6:
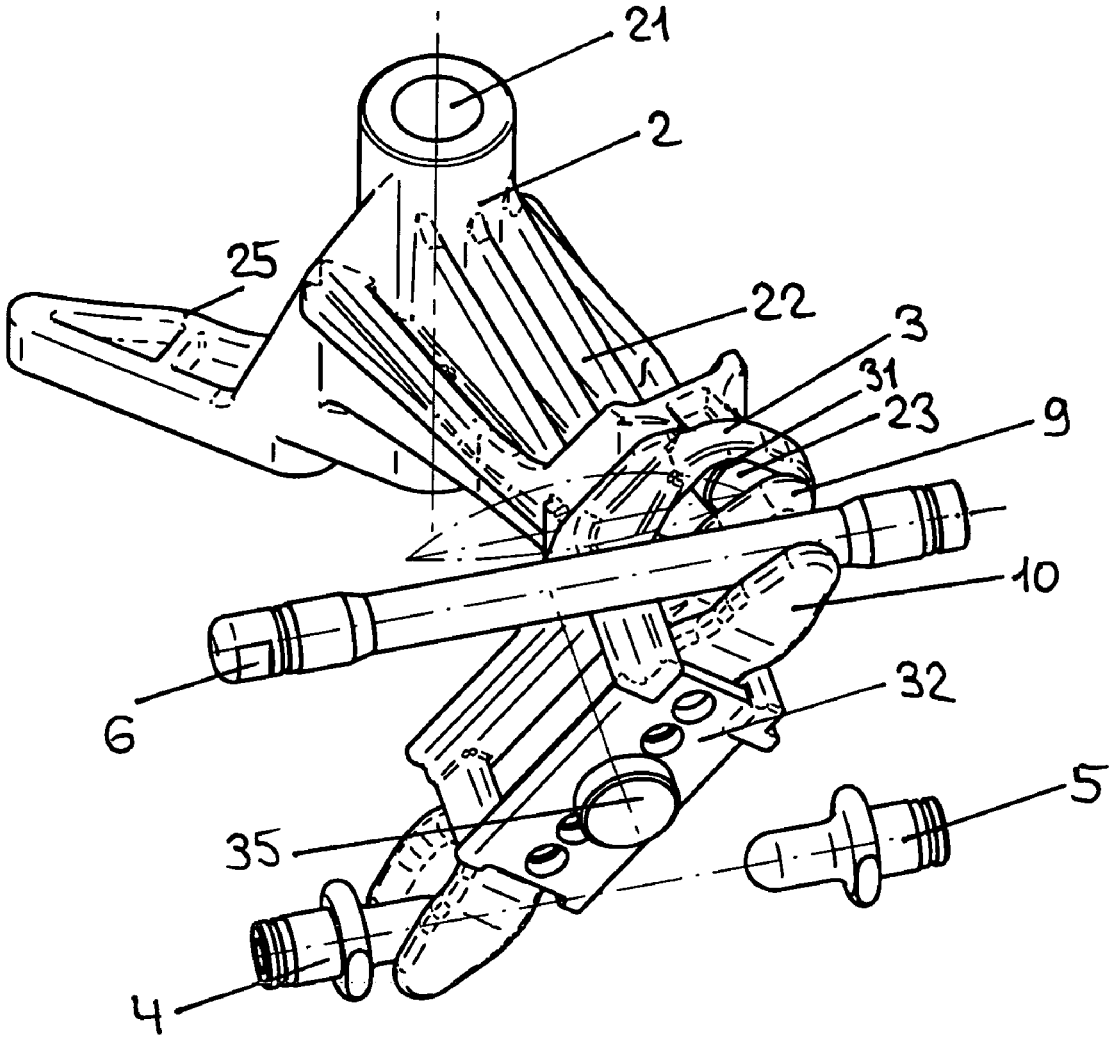
FIG. 6 is a schematic illustration of the cooperation between switching lever, contact housing, and contacts in the inventive switch contact.

FIG. 6 shows the combination of the switching lever 2, the contact housing 3, and the contact fingers 9 and 10. In this illustration, the contact rod 6 is continuous, i.e. a single piece.

This is advantageous in the context of the invention, but is not a necessary feature; instead of such a contact rod, separate contacts, just like the contacts 4 and 5, can be made as separate contact pieces just as well. The manner in which the inventive mechanical switch contact works will be explained using this figure. If during actuation of the load transfer switch a roller or the like is moved into the actuation cam 25 of the switching lever 2 and runs onto the latter, the entire switching lever 2 is pivoted about its bearing 21. Its entrainment element 23, which is guided in a form fit in the entrainment element opening 31 of the contact housing 3, pivots this contact housing 3 about its bearing 34. Thus the parallel contact fingers 9, 10 attached thereto switch the fixed contacts 4 and 5 or slide on the contact rod 6, which is embodied as a single piece here. It can be seen that the two contact fingers 9 and 10 enclose the fixed contact on both sides. The contact springs that are present in such parallel contact fingers for producing the necessary contact pressure have been omitted here for reasons of clarity. The components that have been explained inventively act as a spatial 3-D gearing.

Use is made of the physical effect of the effect of the current forces. If two lines are parallel and if current flows through them simultaneously in opposite directions, they mutually repel one another; when the current flows in the same direction they are attracted to one another. This physical effect of mutual attraction is realized by the two parallel contact fingers 9 and 10 that flank the fixed contacts on both sides and through which current flows in the same direction, in conjunction with the described 3-D gearing for its actuation. This is an essential advantage of the invention relative to the prior art.

Figure 7:
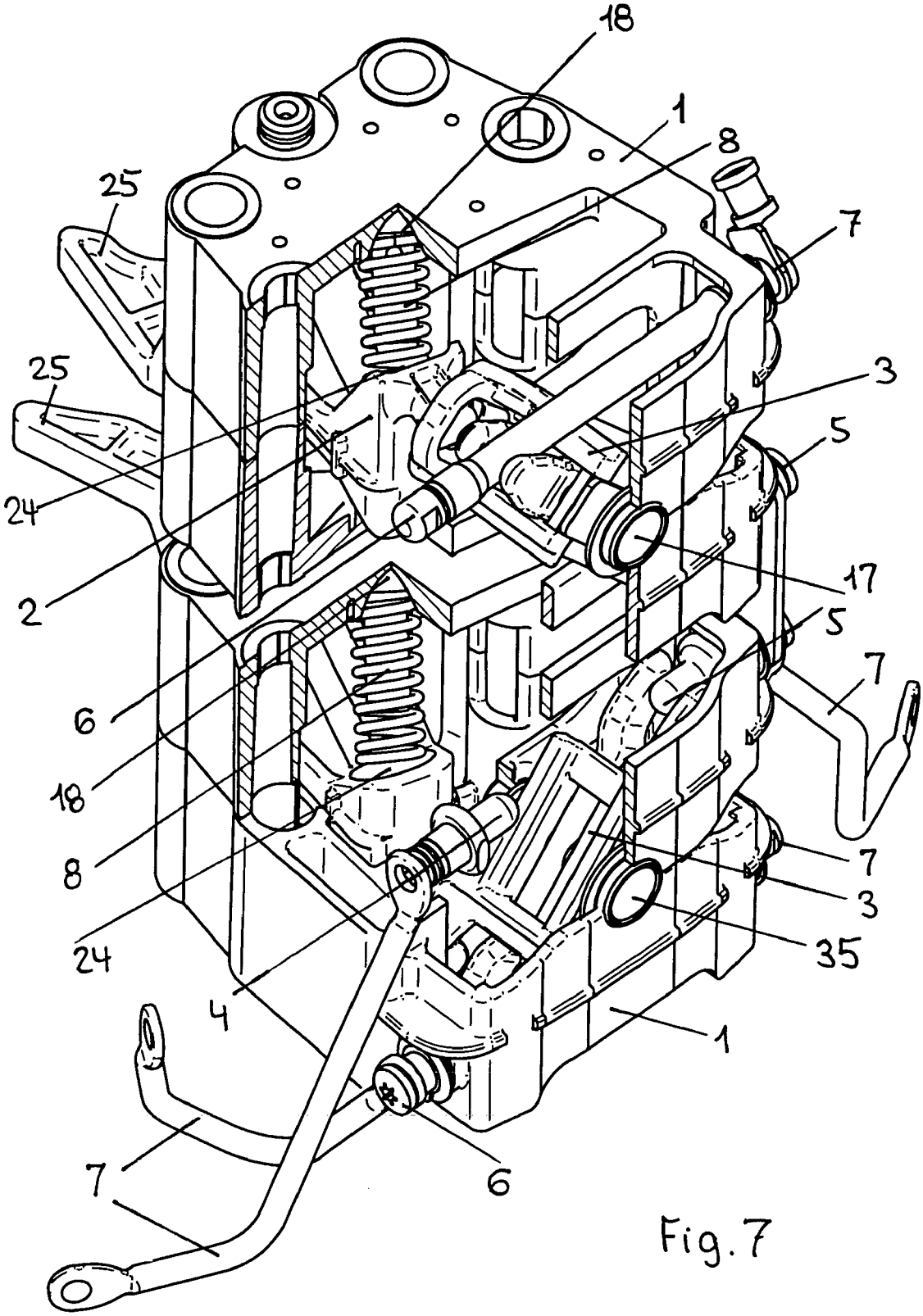
FIG. 7 is a combination of two inventive switch contacts in accordance with FIG. 1 as a combined single-phase assembly for main switch contact and resistance switch contact of a tap changer.

FIG. 7 shows two of these inventive switch contacts that have been combined to create a complete mechanical switching unit for one phase of a load transfer switch. The one switch I acts as the main contact and the other switch contact II acts as the resistance switch contact. Identical parts are provided with the same reference numbers; it can be seen that both modules are constructed entirely identically. For reasons of clarity, not all of the details that were explained have been provided with reference numbers in this illustration; in addition to the components that have already been explained, electrical connection lines 7 have also been added to the illustration. In this figure the compression springs 8 are clearly visible, each being provided between a cup-shaped seat 18 of the insulating support 1 and a cup-shaped counterbearing seat 24 of the switching lever 2. Using these compression springs 8, which constitute a force-exerting means, attains a toggle action; the switching lever 2 is pivoted against the force of the prestressed compression spring 8 and after passing the dead point reliably travels into the other end position. As stated in the foregoing, both modules are basically identical; however, it is possible, and in many cases reasonable, to configure the actuation cams 25 of the two switching levers 2 differently in order to vary the switching sequence and speed.

Figure 8:
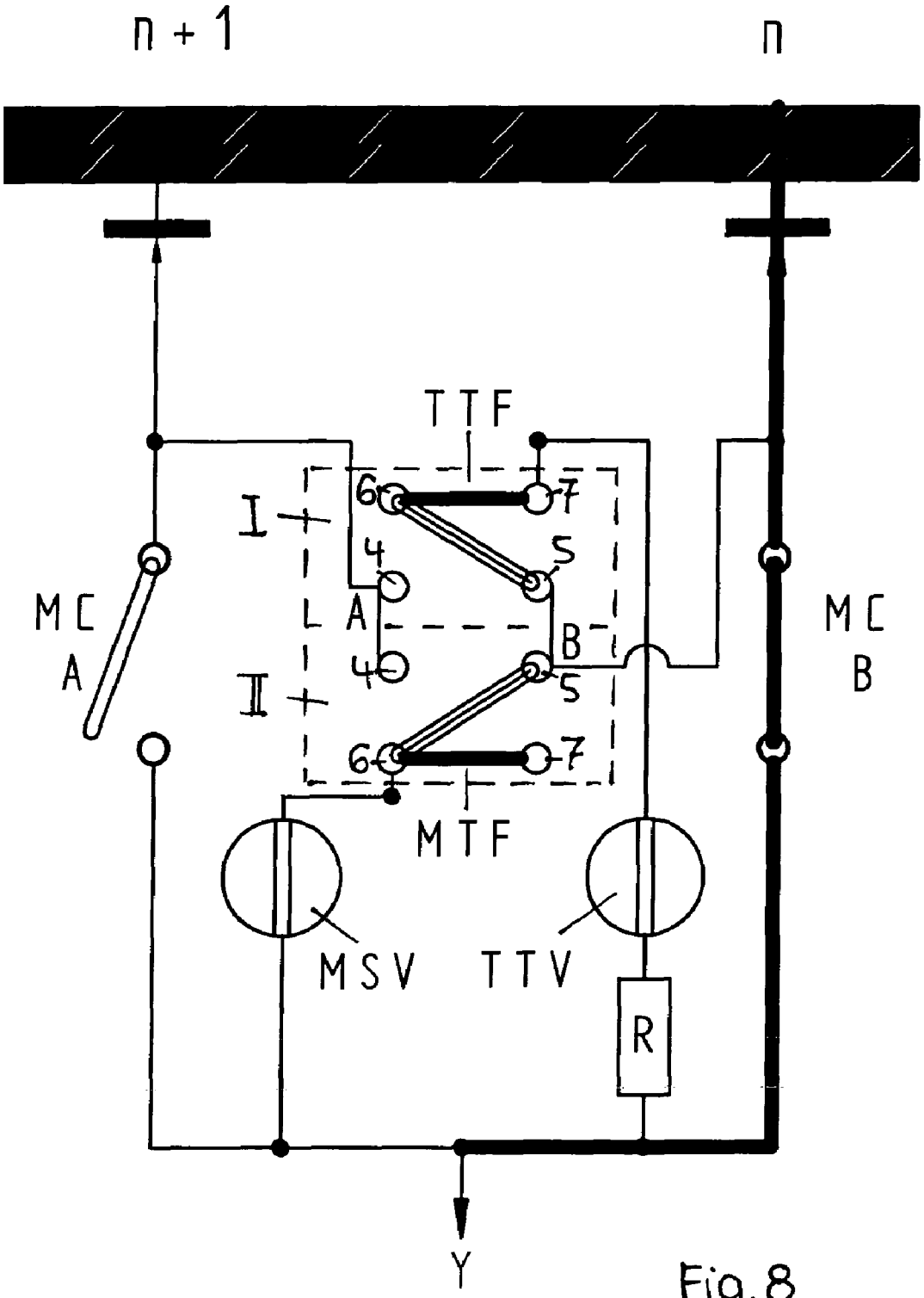
FIG. 8 is a circuit for a load transfer switch of a tap changer using the inventive mechanical switch contacts.

FIG. 8 shows the electrical circuit of a tap changer that can be provided with the arrangement of two switch contacts explained in FIG. 7. Shown in the upper area of the circuit is the selector for the tap changer, which performs a powerless preselection of the new coil tap n+1, to which switching is to occur, while the former coil tap n is electrically switched. Below this, both sides of the load transfer switch A and B are shown, between which then interruption-less switching under load is to occur. The contacts MCA and MCD are the permanent main contacts, of which one is closed in stationary operation and is therefore live. MSV is a vacuum switching cell in the main switching branch. TTV is a vacuum switching cell in a resistance branch that has the additional transition resistor R. The broken lines indicate the part of the circuit that is technically realized by the two inventive switch contacts I and II. The switch contact II acting as the main switch contact is labeled MTF, and the mechanical switch contact acting as the resistance switch contact is labeled TTF. Y is the load leakage.

The invention claimed is:

1. A mechanical switch contact for switching a load transfer switch, the switch contact comprising:

an insulating support;

fixed switchable contacts on the support;

a switching lever rotatably mounted on the insulating support and having a pivot arm at one of its two free ends and an actuating cam at the other free end, means for exerting a force on the actuating cam for pivoting the switching lever in a spring-like manner from one of two stable end positions to the other of the two stable end positions;

a contact housing mounted on the insulating support and pivotal about a separate bearing; and two parallel contact fingers electrically connected to one another and flanking the switched fixed contacts on both sides, the contact housing being mechanically connected to the switching lever and actuatable thereby.

2. The mechanical switch contact in accordance with claim 1 wherein the switching lever has an entrainment element that engages in a form fit in an entrainment element opening of the contact housing.

3. The mechanical switch contact in accordance with claim 1 wherein one of the fixed contacts is formed as a contact rod on which the contact fingers slide when the contact housing moves.

* * * * *